US007176953B2

(12) United States Patent
Saquib et al.

(10) Patent No.: US 7,176,953 B2
(45) Date of Patent: Feb. 13, 2007

(54) THERMAL RESPONSE CORRECTION SYSTEM

(75) Inventors: Suhail S. Saquib, Shrewsbury, MA (US); William T. Vetterling, Lexington, MA (US)

(73) Assignee: Polaroid Corporation, Waltham, MA (US)

( * ) Notice: Subject to any disclaimer, the term of this patent is extended or adjusted under 35 U.S.C. 154(b) by 262 days.

(21) Appl. No.: 10/988,896

(22) Filed: Nov. 15, 2004

(65) Prior Publication Data

US 2005/0068404 A1 Mar. 31, 2005

Related U.S. Application Data

(63) Continuation-in-part of application No. 09/934,703, filed on Aug. 22, 2001, now Pat. No. 6,819,347.

(51) Int. Cl.
*B41J 2/36* (2006.01)
*B41J 2/365* (2006.01)

(52) U.S. Cl. ..... 347/185

(58) Field of Classification Search ..... 347/19, 347/185, 188, 189, 194, 195, 196; 400/120.09, 400/120.14

See application file for complete search history.

(56) References Cited

U.S. PATENT DOCUMENTS

| | | | | |
|---|---|---|---|---|
| 4,070,587 | A | 1/1978 | Hanakata | 307/141 |
| 4,284,876 | A | 8/1981 | Ishibashi et al. | 219/216 |
| 4,309,712 | A | 1/1982 | Iwakura | |
| 4,347,518 | A | 8/1982 | Williams et al. | |
| 4,364,063 | A | 12/1982 | Anno | |
| 4,391,535 | A | 7/1983 | Palmer | 400/120 |
| 4,415,908 | A | 11/1983 | Sugiura | |
| 4,443,121 | A | 4/1984 | Arai | 400/120 |
| 4,464,669 | A | 8/1984 | Sekiya et al. | |
| 4,514,738 | A | 4/1985 | Nagato et al. | |
| 4,524,368 | A | 6/1985 | Inui et al. | |
| 4,563,691 | A | 1/1986 | Noguchi et al. | |
| 4,567,488 | A | 1/1986 | Moriguchi et al. | 346/76 PH |
| 4,607,262 | A | 8/1986 | Moriguchi et al. | |
| 4,688,051 | A | 8/1987 | Kawakami et al. | |
| 5,006,866 | A | 4/1991 | Someya | |
| 5,066,961 | A | 11/1991 | Yamashita | |
| 5,086,306 | A | 2/1992 | Sasaki | |

(Continued)

FOREIGN PATENT DOCUMENTS

| | | |
|---|---|---|
| JP | 58-164368 | 9/1983 |

(Continued)

*Primary Examiner*—K. Feggins

(57) ABSTRACT

A model of a thermal print head is provided that models the thermal response of thermal print head elements to the provision of energy to the print head elements over time. The thermal print head model generates predictions of the temperature of each of the thermal print head elements at the beginning of each print head cycle based on: (1) the current ambient temperature of the thermal print head, (2) the thermal history of the print head, (3) the energy history of the print head, and (optionally) (4) the current temperature of the print medium. The amount of energy to provide to each of the print head elements during a print head cycle to produce a spot having the desired density is calculated based on: (1) the desired density to be produced by the print head element during the print head cycle, and (2) the predicted temperature of the print head element at the beginning of the print head cycle.

10 Claims, 11 Drawing Sheets

U.S. PATENT DOCUMENTS

| | | | | |
|---|---|---|---|---|
| 5,115,252 | A | 5/1992 | Sasaki | |
| 5,132,703 | A | 7/1992 | Nakayama | |
| 5,132,709 | A | 7/1992 | West | |
| 5,162,813 | A | 11/1992 | Kuroiwa et al. | |
| 5,184,150 | A | 2/1993 | Sugimoto | |
| 5,248,995 | A | 9/1993 | Izumi | |
| 5,268,706 | A | 12/1993 | Sakamoto | |
| 5,422,662 | A | 6/1995 | Fukushima | 342/211 |
| 5,539,443 | A | 7/1996 | Mushika et al. | 347/194 |
| 5,576,745 | A | 11/1996 | Matsubara | 347/14 |
| 5,623,297 | A | 4/1997 | Austin et al. | 347/194 |
| 5,625,399 | A | 4/1997 | Wiklof et al. | 347/195 |
| 5,642,148 | A | 6/1997 | Fukushima | 347/211 |
| 5,644,351 | A | 7/1997 | Matsumoto et al. | 347/194 |
| 5,646,672 | A | 7/1997 | Fukushima | 347/211 |
| 5,706,044 | A | 1/1998 | Fukushima | 347/211 |
| 5,719,615 | A | 2/1998 | Hashiguchi et al. | 347/195 |
| 5,800,075 | A | 9/1998 | Katsuma et al. | 400/120 |
| 5,808,653 | A | 9/1998 | Matsumoto et al. | 347/194 |
| 5,841,461 | A | 11/1998 | Katsuma | 347/195 |
| 5,889,546 | A | 3/1999 | Fukuoka | 347/188 |
| 5,999,204 | A | 12/1999 | Kojima | 347/194 |
| 6,186,683 | B1 | 2/2001 | Shibuki | 400/120.8 |
| 6,537,410 | B2 | 3/2003 | Arnost et al. | 156/235 |
| 2003/0043251 | A1 | 3/2003 | Saquib et al. | 347/194 |
| 2004/0196352 | A1 | 10/2004 | Busch et al. | 347/189 |

FOREIGN PATENT DOCUMENTS

| | | |
|---|---|---|
| JP | 59-127781 | 7/1984 |
| JP | 02-248264 | 10/1990 |
| JP | 02-289364 | 11/1990 |
| JP | 3-024972 | 2/1991 |
| JP | 03-024972 | 2/1991 |
| JP | H03-24972 | 2/1991 |

THERMAL RESPONSE CORRECTION SYSTEM

CROSS-REFERENCE TO RELATED APPLICATIONS

This application is a continuation-in-part of U.S. patent application Ser. No. 09/934,703, filed on Aug. 22, 2001, now U.S. Pat. No. 6,819,317, entitled "Thermal Response Correction System," hereby incorporated by reference.

BACKGROUND

1. Field of the Invention

The present invention relates to thermal printing and, more particularly, to techniques for improving thermal printer output by compensating for the effects of thermal history on thermal print heads.

2. Related Art

Thermal printers typically contain a linear array of heating elements (also referred to herein as "print head elements") that print on an output medium by, for example, transferring pigment from a donor sheet to the output medium or by initiating a color-forming reaction in the output medium. The output medium is typically a porous receiver receptive to the transferred pigment, or a paper coated with the color-forming chemistry. Each of the print head elements, when activated, forms color on the medium passing underneath the print head element, creating a spot having a particular density. Regions with larger or denser spots are perceived as darker than regions with smaller or less dense spots. Digital images are rendered as two-dimensional arrays of very small and closely-spaced spots.

A thermal print head element is activated by providing it with energy. Providing energy to the print head element increases the temperature of the print head element, causing either the transfer of colorant to the output medium or the formation of color in the output medium. The density of the output produced by the print head element in this manner is a function of the amount of energy provided to the print head element. The amount of energy provided to the print head element may be varied by, for example, varying the amount of power to the print head element within a particular time interval or by providing power to the print head element for a longer time interval.

In conventional thermal printers, the time during which a digital image is printed is divided into fixed time intervals referred to herein as "print head cycles." Typically, a single row of pixels (or portions thereof) in the digital image is printed during a single print head cycle. Each print head element is typically responsible for printing pixels (or subpixels) in a particular column of the digital image. During each print head cycle, an amount of energy is delivered to each print head element that is calculated to raise the temperature of the print head element to a level that will cause the print head element to produce output having the desired density. Varying amounts of energy may be provided to different print head elements based on the varying desired densities to be produced by the print head elements.

One problem with conventional thermal printers results from the fact that their print head elements retain heat after the conclusion of each print head cycle. This retention of heat can be problematic because, in some thermal printers, the amount of energy that is delivered to a particular print head element during a particular print head cycle is typically calculated based on an assumption that the print head element's temperature at the beginning of the print head cycle is a known fixed temperature. Since, in reality, the temperature of the print head element at the beginning of a print head cycle depends on (among other things) the amount of energy delivered to the print head element during previous print head cycles, the actual temperature achieved by the print head element during a print head cycle may differ from the calibrated temperature, thereby resulting in a higher or lower output density than is desired. Further complications are similarly caused by the fact that the current temperature of a particular print head element is influenced not only by its own previous temperatures—referred to herein as its "thermal history"—but by the ambient (room) temperature and the thermal histories of other print head elements in the print head.

As may be inferred from the discussion above, in some conventional thermal printers, the average temperature of each particular thermal print head element tends to gradually rise during the printing of a digital image due to retention of heat by the print head element and the over-provision of energy to the print head element in light of such heat retention. This gradual temperature increase results in a corresponding gradual increase in density of the output produced by the print head element, which is perceived as increased darkness in the printed image. This phenomenon is referred to herein as "density shift."

Furthermore, conventional thermal printers typically have difficulty accurately reproducing sharp density gradients between adjacent pixels in both the fast scan and slow scan direction. For example, if a print head element is to print a white pixel following a black pixel, the ideally sharp edge between the two pixels will typically be blurred when printed. This problem results from the amount of time that is required to raise the temperature of the print head element to print the black pixel after printing the white pixel. More generally, this characteristic of conventional thermal printers results in less than ideal sharpness when printing images having regions of high density gradient.

What is needed, therefore, are improved techniques for controlling the temperature of print head elements in a thermal printer to more accurately render digital images.

SUMMARY

A model of a thermal print head is provided that models the thermal response of thermal print head elements to the provision of energy to the print head elements over time. The thermal print head model generates predictions of the temperature of each of the thermal print head elements at the beginning of each print head cycle based on: (1) the current ambient temperature of the thermal print head, (2) the thermal history of the print head, (3) the energy history of the print head, and (optionally) (4) the current temperature of the print medium. The amount of energy to provide to each of the print head elements during a print head cycle to produce a spot having the desired density is calculated based on: (1) the desired density to be produced by the print head element during the print head cycle, and (2) the predicted temperature of the print head element at the beginning of the print head cycle.

Additional aspects and embodiments of the present invention will be described in more detail below.

DETAILED DESCRIPTION

In one aspect of the present invention, a model of a thermal print head is provided that models the thermal response of thermal print head elements to the provision of energy to the print head elements over time. The history of temperatures of print head elements of a thermal print head is referred to herein as the print head's "thermal history." The distribution of energies to the print head elements over time is referred to herein as the print head's "energy history."

In particular, the thermal print head model generates predictions of the temperature of each of the thermal print head elements at the beginning of each print head cycle based on: (1) the current ambient temperature of the thermal print head, (2) the thermal history of the print head, (3) the energy history of the print head, and (optionally) (4) the current temperature of the print medium. In one embodiment of the present invention, the thermal print head model generates a prediction of the temperature of a particular thermal print head element at the beginning of a print head cycle based on: (1) the current ambient temperature of the thermal print head, (2) the predicted temperatures of the print head element and one or more of the other print head elements in the print head at the beginning of the previous print head cycle, and (3) the amount of energy provided to the print head element and one or more of the other print head elements in the print head during the previous print head cycle.

In one embodiment of the present invention, the amount of energy to provide to each of the print head elements during a print head cycle to produce a spot having the desired density is calculated based on: (1) the desired density to be produced by the print head element during the print head cycle, and (2) the predicted temperature of the print head element at the beginning of the print head cycle. It should be appreciated that the amount of energy provided to a particular print head element using such a technique may be greater than or less than that provided by conventional thermal printers. For example, a lesser amount of energy may be provided to compensate for density drift. A greater amount of energy may be provided to produce a sharp density gradient. The model used by various embodiments of the present invention is flexible enough to either increase or decrease the input energies as appropriate to produce the desired output densities.

Use of the thermal print head model decreases the sensitivity of the print engine to the ambient temperature of the print head and to previously printed image content, which manifests itself in the thermal history of the print head elements.

Figure 1:
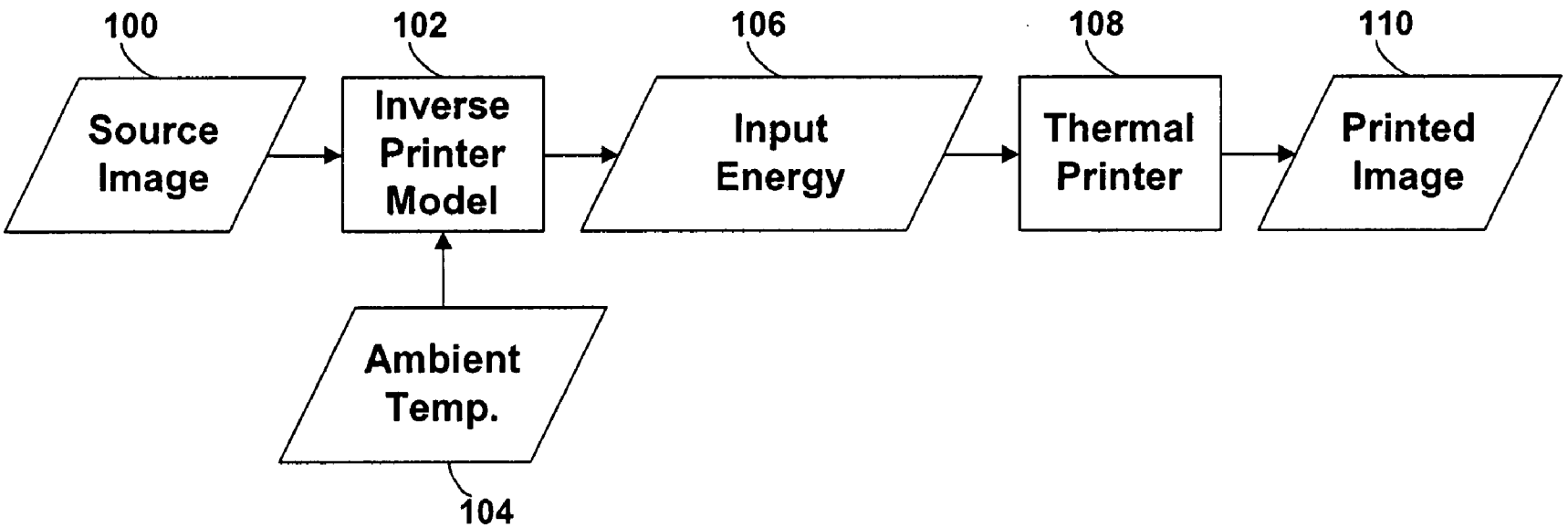
FIG. 1 is a data flow diagram of a system that is used to print digital images according to one embodiment of the present invention.

For example, referring to FIG. 1, a system for printing images is shown according to one embodiment of the present invention. The system includes an inverse printer model 102, which is used to compute the amount of input energy 106 to be provided to each print head element in a thermal printer 108 when printing a particular source image 100. As described in more detail below with respect to FIGS. 2 and 3, a thermal printer model 302 models the output (e.g., the printed image 110) produced by thermal printer 108 based on the input energy 106 that is provided to it. Note that the thermal printer model 302 includes both a print head temperature model and a model of the media response. The inverse printer model 102 is an inverse of the thermal printer model 302. More particularly, the inverse printer model 102 computes the input energy 106 for each print head cycle based on the source image 100 (which may, for example, be a two-dimensional grayscale or color digital image) and the current ambient temperature 104 of the thermal printer's print head. The thermal printer 108 prints a printed image 110 of the source image 100 using the input energy 106. It should be appreciated that the input energy 106 may vary over time and for each of the print head elements. Similarly, the ambient temperature of the print head 104 may vary over time.

In general, the inverse printer model 102 models the distortions that are normally produced by the thermal printer 108 (such as those resulting from density drift, as described above and those resulting from the media response) and "pre-distorts" the source image 100 in an opposite direction to effectively cancel out the distortions that would otherwise be produced by the thermal printer 108 when printing the printed image 110. Provision of the input energy 106 to the thermal printer 108 therefore produces the desired densities in the printed image 110, which therefore does not suffer from the problems (such as density drift and degradation of sharpness) described above. In particular, the density distribution of the printed image 110 more closely matches the density distribution of the source image 100 than the density distributions typically produced by conventional thermal printers.

Figure 2:
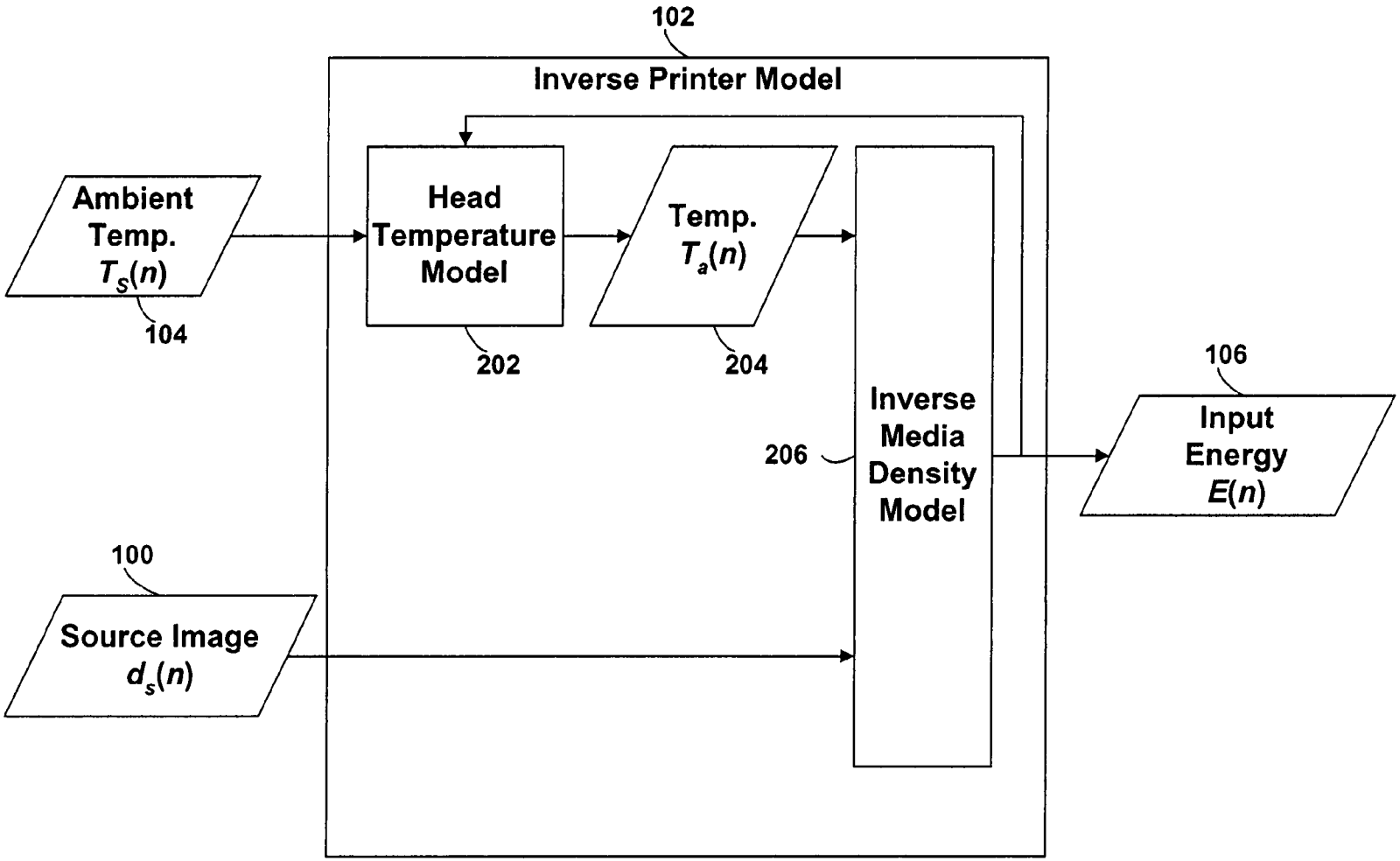
FIG. 2 is a data flow diagram of an inverse printer model used in one embodiment of the present invention.
Figure 3:
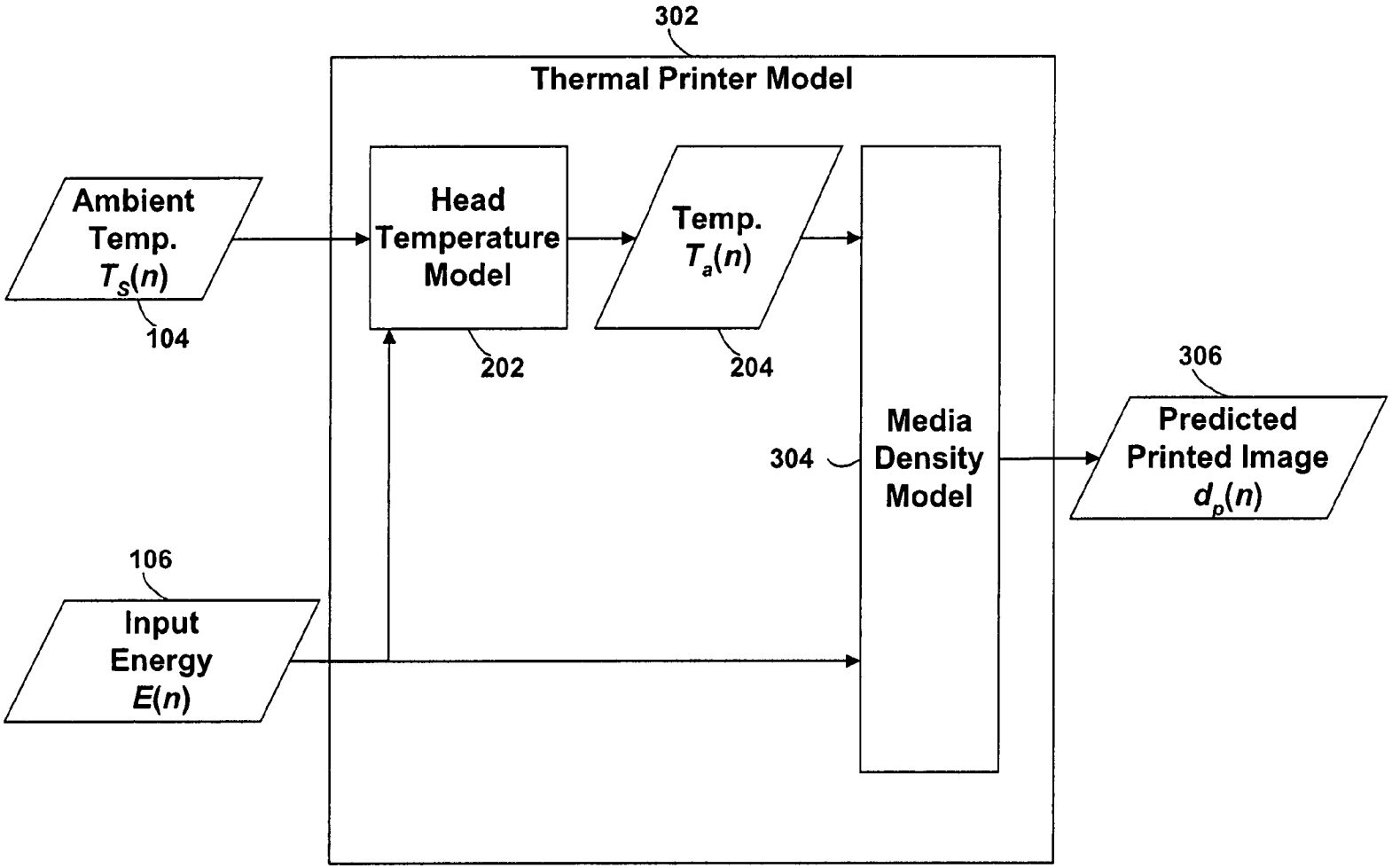
FIG. 3 is a data flow diagram of a thermal printer model used in one embodiment of the present invention.

As shown in FIG. 3, thermal printer model 302 is used to model the behavior of the thermal printer 108 (FIG. 1). As described in more detail with respect to FIG. 2, the thermal printer model 302 is used to develop the inverse printer model 102, which is used to develop input energy 106 to provide to the thermal printer 108 to produce the desired output densities in printed image 110 by taking into account the thermal history of the thermal printer 108. In addition, the thermal printer model 302 is used for calibration purposes, as described below.

Before describing the thermal printer model 302 in more detail, certain notation will be introduced. The source image 100 (FIG. 1) may be viewed as a two-dimensional density distribution $d_s$ having r rows and c columns. In one embodiment of the present invention, the thermal printer 108 prints one row of the source image 100 during each print head cycle. As used herein, the variable n will be used to refer to discrete time intervals (such as particular print head cycles). Therefore, the print head ambient temperature 104 at the beginning of time interval n is referred to herein as $T_S(n)$. Similarly, $d_s(n)$ refers to the density distribution of the row of the source image 100 being printed during time interval n.

Similarly, it should be appreciated that the input energy 106 may be viewed as a two-dimensional energy distribution E. Using the notation just described, E(n) refers to the one-dimensional energy distribution to be applied to the thermal printer's linear array of print head elements during time interval n. The predicted temperature of a print head element is referred to herein as $T_a$. The predicted temperatures for the linear array of print head elements at the beginning of time interval n is referred to herein as $T_a(n)$.

As shown in FIG. 3, the thermal printer model 302 takes as inputs during each time interval n: (1) the ambient temperature $T_S(n)$ 104 of the thermal print head at the beginning of time interval n, and (2) the input energy E(n) 106 to be provided to the thermal print head elements during time interval n. The thermal printer model 302 produces as an output a predicted printed image 306, one row at a time. The predicted printed image 306 may be seen as a two-dimensional distribution of densities $d_p(n)$. The thermal printer model 302 includes a head temperature model 202 (as described in more detail below with respect to FIG. 2) and a media density model 304. The media density model 304 takes as inputs the predicted temperatures $T_a(n)$ 204 produced by the head temperature model 202 and the input energy E(n) 106, and produces as an output the predicted printed image 306.

Referring to FIG. 2, one embodiment of the inverse printer model 102 is shown. The inverse printer model 102 receives as inputs for each time interval n: (1) the print head ambient temperature 104 $T_S(n)$ at the beginning of time interval n, and (2) the densities $d_s(n)$ of the row of the source image 100 to be printed during time interval n. The inverse printer model 102 produces the input energy E(n) 106 as an output.

Inverse printer model 102 includes head temperature model 202 and an inverse media density model 206. In general, the head temperature model 202 predicts the temperatures of the print head elements over time while the printed image 110 is being printed. More specifically, the head temperature model 202 outputs a prediction of the temperatures $T_a(n)$ of the print head elements at the beginning of a particular time interval n based on: (1) the current ambient temperature of the print head $T_S(n)$ 104, and (2) the input energy E(n−1) that was provided to the print head elements during time interval n−1.

In general, the inverse media density model 206 computes the amount of energy E(n) 106 to provide to each of the print head elements during time interval n based on: (1) the predicted temperatures $T_a(n)$ of each of the print head elements at the beginning of time interval n, and (2) the desired densities $d_s(n)$ 100 to be output by the print head elements during time interval n. The input energy E(n) 106 is provided to the head temperature model 202 for use during the next time interval n+1. It should be appreciated that the inverse media density model 206, unlike the techniques typically used by conventional thermal printers, takes both the current (predicted) temperatures $T_a(n)$ of the print head elements and the temperature-dependent media response into account when computing the energy E(n) 106, thereby achieving an improved compensation for the effects of thermal history and other printer-induced imperfections.

Although not shown explicitly in FIG. 2, the head temperature model 202 may internally store at least some of the predicted temperatures $T_a(n)$, and it should therefore be appreciated that previous predicted temperatures (such as $T_a(n-1)$) may also be considered to be inputs to the head temperature model 202 for use in computing $T_a(n)$.

Figure 4:
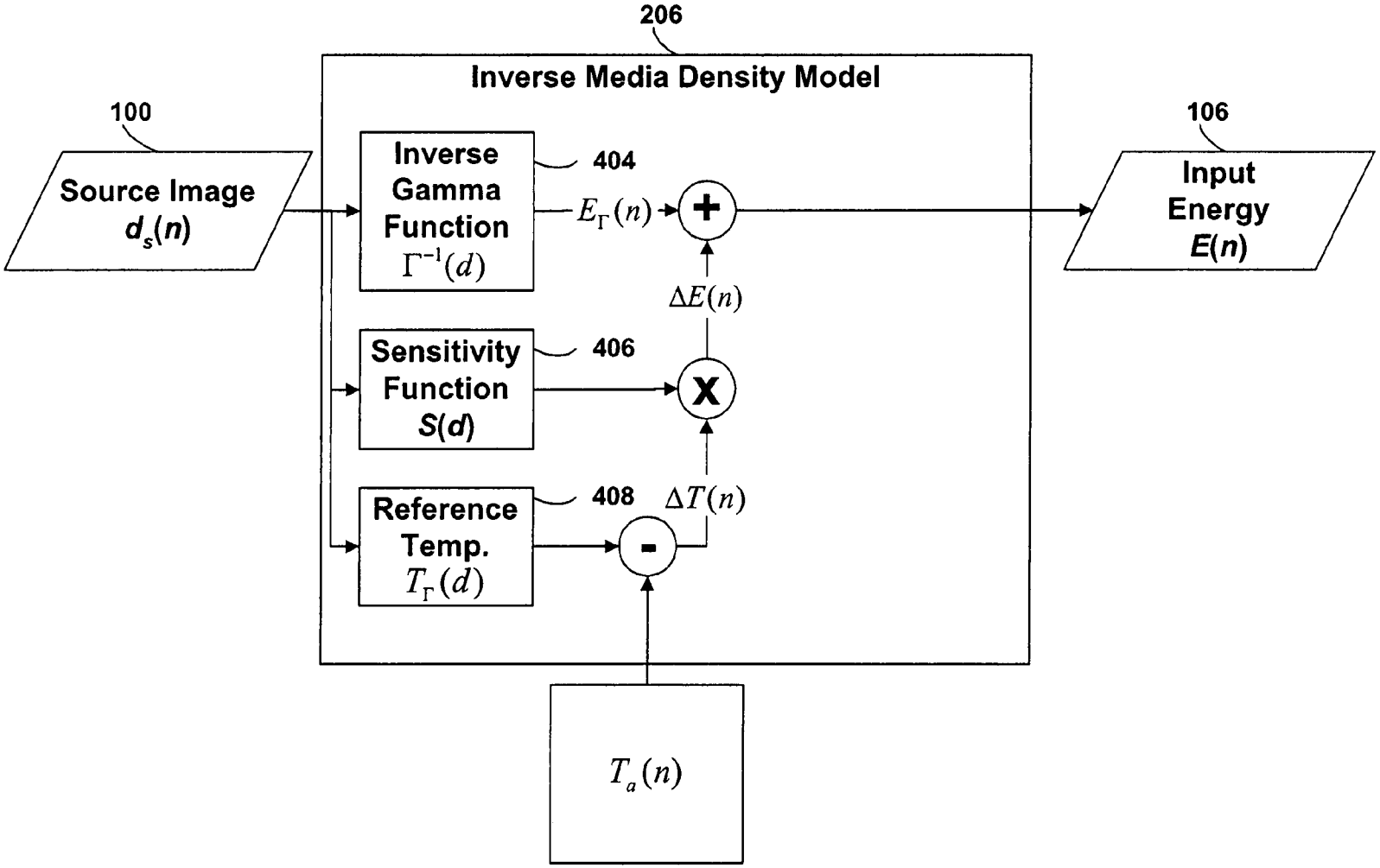
FIG. 4 is a data flow diagram of an inverse media density model used in one embodiment of the present invention.

Referring to FIG. 4, one embodiment of the inverse media density model 206 (FIG. 2) is now described in more detail. The inverse media density model 206 receives as inputs during each time interval n: (1) the source image densities $d_s(n)$ 100, and (2) $T_a(n)$, the predicted temperatures of the thermal print head elements at the beginning of time interval n. The inverse media density model 206 produces as an output the input energy E(n) 106.

In other words, the transfer function defined by the inverse media density model 206 is a two-dimensional function $E=F(d,T_a)$. In non-thermal printers, the transfer function relating input energy E and output density d is typically a one dimensional function $d=\Gamma(E)$, referred to herein as a gamma function. In thermal printers, such a gamma function is not unique because the output density d is dependent not only on the input energy E but also on the current thermal print head element temperature. If, however, we introduce a second function $T_\Gamma(d)$ that represents the temperature of the print head element when the gamma function $d=\Gamma(E)$ was measured, then the combination of the functions $\Gamma(E)$ and $T_\Gamma(d)$ uniquely describes the response of the thermal printer.

In one embodiment, the function $E=F(d,T_a)$ described above is represented using the form shown by Equation 1:

$$E=\Gamma^{-1}(d)+S(d)(T_a-T_\Gamma(d)) \qquad \text{Equation 1}$$

This equation may be interpreted as the first two terms of a Taylor series expansion in $(T_a-T_\Gamma(d))$ for the exact energy that would provide the desired density. In Equation 1, $\Gamma^{-1}(d)$ is the inverse of the function $\Gamma$ (E) described above, and S(d) is a sensitivity function which may take any form, one example of which is described in more detail below. Note that Equation 1 represents the two-dimensional function $E=F(d,T_a)$ using three one-dimensional functions: $\Gamma^{-1}(d)$, S(d), and $T_\Gamma(d)$. In one embodiment of the present invention, the inverse media density model 206 uses Equation 1 to compute the input energies E(n) 106, as illustrated diagrammatically in FIG. 4. The reference temperatures $T_\Gamma(d)$ 408 of the print head elements are subtracted from the current (predicted) temperatures $T_a(n)$ of the print head elements (which may, for example, either be generated by the head temperature model 202 or be actual temperature measurements) to develop temperature differences $\Delta T(n)$. The temperature differences $\Delta T(n)$ are multiplied by the output of sensitivity function S(d) 406 to produce correction factors $\Delta E(n)$, which are added to the uncorrected energies $E_\Gamma(n)$ output by $\Gamma^{-1}(d)$ 404 to produce input energies E(n) 106. It should be appreciated that correction factors $\Delta E(n)$ may be computed and applied either in the log domain or the linear domain, with the calibration performed accordingly.

An alternative implementation of Equation 1 according to one embodiment of the present invention is now described. Equation 1 may be rewritten as Equation 2:

$$E=\Gamma^{-1}(d)-S(d)T_\Gamma(d)+S(d)T_a \qquad \text{Equation 2}$$

In one embodiment, the term $\Gamma^{-1}(d)-S(d)T_\Gamma(d)$ is represented and stored as a single one-dimensional function G(d), so that Equation 2 may be rewritten as:

$$E=G(d)+S(d)T_a \qquad \text{Equation 3}$$

In practice, the value of E may be computed using Equation 3 using two lookups: G(d) and S(d), based on the value of d. Such a representation may be advantageous for a variety of reasons. For example, a direct software and/or hardware implementation of $E=F(d,T_a)$ as a two-dimensional function may require a large amount of storage or a significant number of computations to compute the energy E. In contrast, the one dimensional functions G(d) and S(d) may be stored using a relatively small amount of memory, and the inverse media density model 206 may compute the results of Equation 3 using a relatively small number of computations.

Figure 5A:
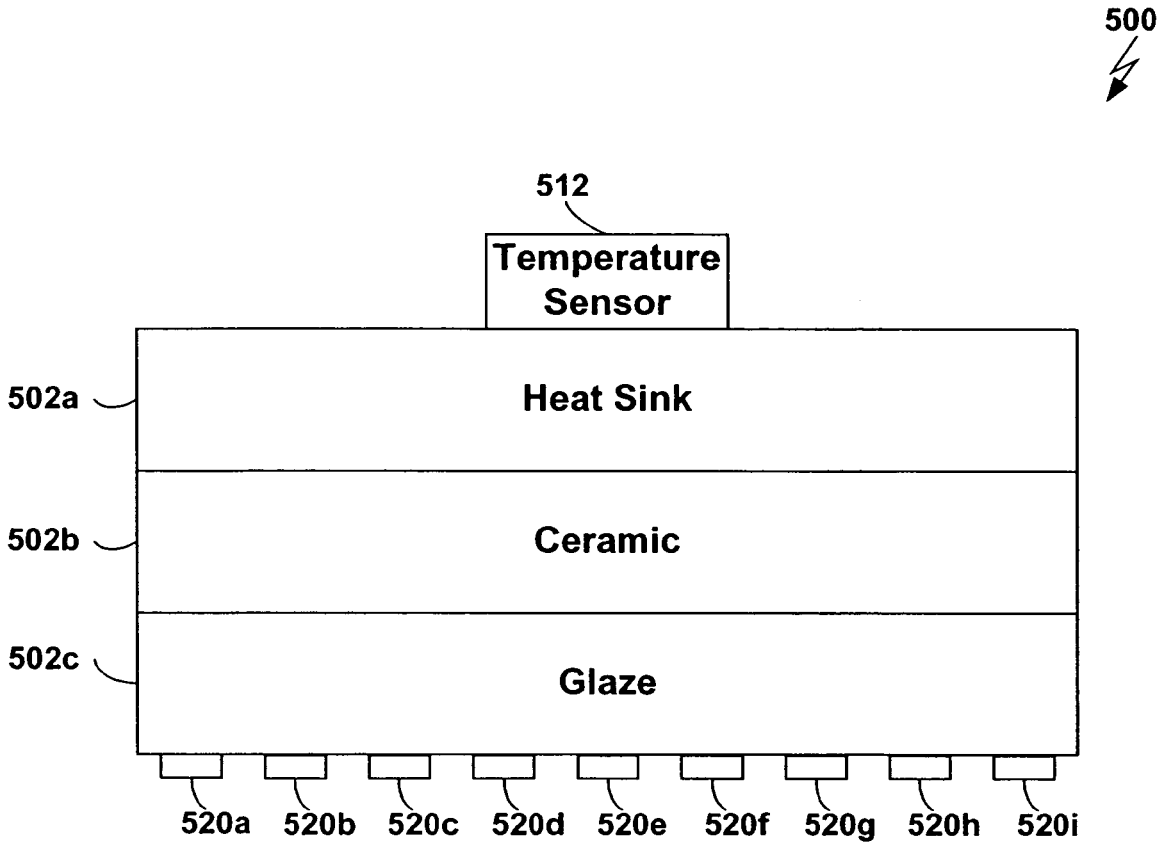
FIG. 5A is a schematic side view of a thermal print head according to one embodiment of the present invention.

One embodiment of the head temperature model 202 (FIGS. 2–3) is now described in more detail. Referring to FIG. 5A, a schematic side view of a thermal print head 500 is shown. The print head 500 includes several layers, including a heat sink 502*a*, ceramic 502*b*, and glaze 502*c*. Underneath the glaze 502*c* is a linear array of print head elements 520*a*–*i*. It should be appreciated that although only nine heating elements 520*a*–*i* are shown in FIG. 5A for ease of illustration, a typical thermal print head will have hundreds of very small and closely-spaced print head elements per inch.

As described above, energy may be provided to the print head elements 520*a*–*i* to heat them, thereby causing them to transfer pigment to an output medium. Heat generated by the print head elements 520*a*–*i* diffuses upward through the layers 502*a*–*c*.

It may be difficult or unduly burdensome to directly measure the temperatures of the individual print head elements 520*a*–*i* over time (e.g., while a digital image is being printed). Therefore, in one embodiment of the present invention, rather than directly measuring the temperatures of the print head elements 520*a*–*i*, the head temperature model 202 is used to predict the temperatures of the print head elements 520*a*–*i* over time. In particular, the head temperature model 202 may predict the temperatures of the print head elements 520*a*–*i* by modeling the thermal history of the print head elements 520*a*–*i* using knowledge of: (1) the ambient temperature of the print head 500, and (2) the energy that has been previously provided to the print head elements 520*a*–*i*. The ambient temperature of the print head 500 may be measured using a temperature sensor 512 that measures the temperature $T_S(n)$ at some point on the heat sink 512.

The head temperature model 202 may model the thermal history of the print head elements 520*a*–*i* in any of a variety of ways. For example, in one embodiment of the present invention, the head temperature model 202 uses the temperature $T_S(n)$ measured by temperature sensor 512, in conjunction with a model of heat diffusion from the print head elements 520*a*–*i* to the temperature sensor 512 through the layers of the print head 500, to predict the current temperatures of the print head elements 520*a*–*i*. It should be appreciated, however, that the head temperature model 202 may use techniques other than modeling heat diffusion through the print head 500 to predict the temperatures of the print head elements 520*a*–*i*.

Figure 5B:
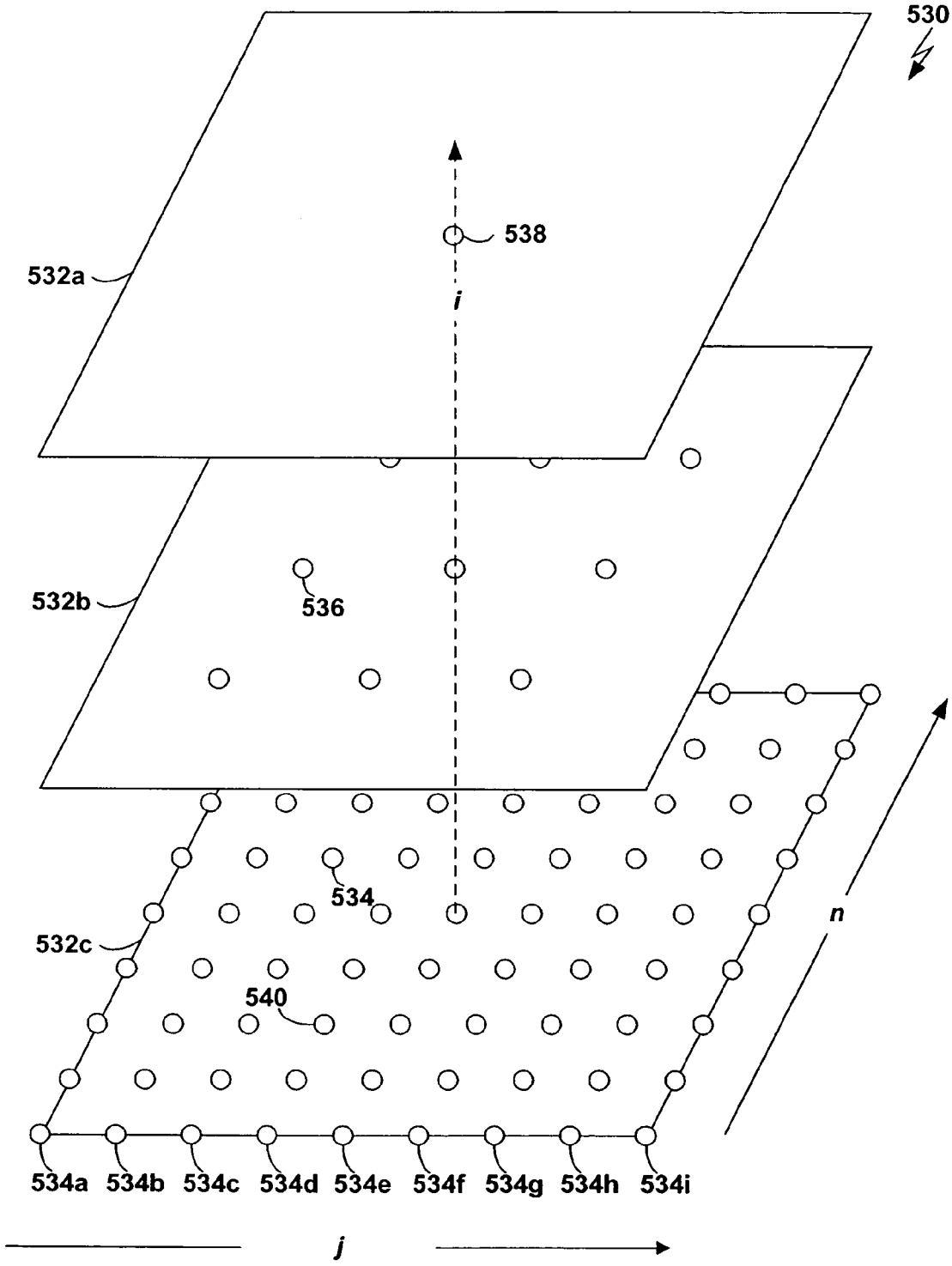
FIG. 5B is a diagram of a spatial/temporal grid used by a head temperature model according to one embodiment of the present invention.

Referring to FIG. 5B, a three-dimensional spatial and temporal grid 530 used by the head temperature model 202 according to one embodiment of the present invention is illustrated diagrammatically. In one embodiment, a multi-resolution heat propagation model uses the grid 530 to model the propagation of heat through the print head 500.

As shown in FIG. 5B, one dimension of the grid 530 is labeled by an i axis. The grid 530 includes three resolutions 532*a*–*c*, each corresponding to a distinct value of i. With respect to the grid 530 shown in FIG. 5B, i=0 corresponds to resolution 532*c*, i=1 corresponds to resolution 532*b*, and i=2 corresponds to resolution 532*a*. The variable i is therefore referred to herein as a "resolution number." Although three resolutions 532*a*–*c* are shown in the grid 530 of FIG. 5B, this is merely an example and does not constitute a limitation of the present invention. Rather, a temporal and spatial grid used by the head temperature model 202 may have any number of resolutions. As used herein, the variable nresolutions refers to the number of resolutions in the spatial and temporal grid used by the head temperature model 202. For example, nresolutions=3 with respect to the grid 530 shown in FIG. 5B. The maximum value of i is nresolutions−1.

Furthermore, although there may be the same number of resolutions as the number of layers in the print head 500 (FIG. 5A), this is not a requirement of the present invention. Rather, there may be a greater or lesser number of resolutions than physical layers of material.

Each of the resolutions 532*a*–*c* of the three-dimensional grid 530 includes a two-dimensional grid of reference points. For example, resolution 532*c* includes a 9×9 array of reference points referred to collectively by reference numeral 534 (only a single one of the reference points in resolution 532*c* is labeled with reference numeral 534 for ease of illustration). Similarly, resolution 532*b* includes a 3×3 array of reference points referred to collectively by reference numeral 536, and resolution 532*a* includes a 1×1 array including a single reference point 538.

As further shown in FIG. 5B, a j axis labels one dimension (the fast scan direction) of each of the resolutions 532*a*–*c*. In one embodiment, the j axis runs from left to right beginning at j=0 and increasing by one at each reference point to a maximum value of $j_{max}$. As further shown in FIG. 5B, an n axis labels the second dimension in each of the resolutions 532*a*–*c*. In one embodiment, the n axis runs in the direction shown by the corresponding arrow (i.e., into the plane of FIG. 5B) beginning at n=0 and increasing by one at each reference point. For ease of explanation, in the description below a particular value of n in resolution i will be said to refer to a corresponding "row" of reference points in resolution i.

In one embodiment, the n axis corresponds to discrete time intervals, such as consecutive print head cycles. For example, n=0 may correspond to a first print head cycle, n=1 may correspond to the succeeding print head cycle, and so on. As a result, in one embodiment, the n dimension is referred to herein as a "temporal" dimension of the spatial and temporal grid 530. Print head cycles may, for example, be numbered sequentially beginning with n=0 when the thermal printer 108 is turned on or when the printing of a digital image is initiated.

It should be appreciated, however, that in general n refers to a time interval, the duration of which may or may not be equal to that of a single print head cycle. Furthermore, the duration of the time interval to which n corresponds may differ for each of the different resolutions 532*a*–*c*. For example, in one embodiment, the time interval referenced by the variable n in resolution 532*c* (i=0) is equal to a single print head cycle, whereas the time intervals referenced by the variable n in the other resolutions 532*a*–*b* are longer than a single print head cycle.

In one embodiment, reference points 534 in resolution 532*c* (for which i=0) have a special significance. In this embodiment, each row of reference points in resolution 532*c* corresponds to the linear array of print head elements 520*a*–*i* in the print head 500 (FIG. 5A). For example, consider the row of reference points 534*a*–*i*, for which i=0 and n=0. In one embodiment, each of these reference points 534*a*–*i* corresponds to one of the print head elements 520*a*–*i* shown in FIG. 5A. For example, reference point 534*a* may correspond to print head element 520*a*, reference point 534*b* may correspond to print head element 520*b*, and so on. The same correspondence may hold between each of the remaining rows of reference points in resolution 532*c* and the print head elements 520*a*–*i*. Because of this correspondence between reference points within a row of reference points and print head elements arranged in a row in the print head 500, in one embodiment the j dimension is referred to as a "spatial" dimension of the spatial and temporal grid 530. Examples of how this correspondence may be used by the head temperature model 202 are described in more detail below.

Using these meanings of the j and n dimensions, each of the reference points 534 in resolution 532*c* (for which i=0) may be seen to correspond to a particular one of the print head elements 520*a–i* at a particular point in time (e.g., at the beginning of a particular print head cycle). For example, j=3 and n=2 may refer to reference point 540 (which corresponds to print head element 520*d*) at the beginning of time interval n=2.

In one embodiment, associated with each of the reference points 534 at coordinates (n,j) in resolution 532*c* (i=0) is an absolute temperature value $T_a$, representing a predicted absolute temperature of the print head element j at the beginning of time interval n. Also associated with each of the reference points 534 at coordinates (n,j) in resolution 532*c* (i=0) is an energy value E, representing the amount of energy to be provided to print head element j during time interval n.

As described in more detail below, in one embodiment of the present invention the head temperature model 202 updates the absolute temperature values $T_a$ associated with reference points in row n of resolution 532*c* at the beginning of each time interval n, thereby predicting the absolute temperatures of the print head elements 520*a–i* at the beginning of time interval n. As further described in more detail below, the head temperature model 202 updates the energy values E associated with the reference points in row n of resolution 532*c* at the beginning of each time interval n based on the updated temperature values $T_a$ and the desired output densities $d_s$. The energies E are then provided to the print head elements 520*a–i* to produce output having the desired densities.

It should be appreciated that there need not be a one-to-one correspondence between reference points in each row of resolution 532*c* of the grid 530 and print head elements in the print head 500. For example, there may be a greater or lesser number of reference points in each such row than the number of print head elements. If the number of reference points in each row of resolution 532*c* is not equal to the number of print head elements, temperature predictions for the reference points may be mapped to the print head elements using, e.g., any form of interpolation or decimation.

More generally, resolution 532*c* (i=0) models an area including some or all of the print head elements 520*a–i*. The area that is modeled may, for example, be equal to, larger than, or smaller than the area occupied by the print head elements 520*a–i*. The number of reference points in each row of resolution 532*c* may be greater than, less than, or equal to the number of print head elements in the modeled area. For example, if the modeled area is larger than the area occupied by all of the print head elements 520*a–i*, one or more reference points at each end of each row in resolution 532*c* may correspond to a "buffer zone" extending before the first print head element 520*a* and after the last print head element 520*i*. One way in which the buffer zone may be used is described in more detail below with respect to Equation 8.

The head temperature model 202 may generate temperature predictions for the reference points 534 in any of a variety of ways. For example, as shown in FIG. 5B, the grid 530 includes additional reference points 536 and 538. As described in more detail below, the head temperature model 202 generates intermediate temperature and energy values for reference points 536 and 538, which are used to generate the final temperature predictions $T_a$ and input energies E associated with reference points 534. The absolute temperature values $T_a$ associated with reference points 536 and 538 may, but need not, correspond to predictions of absolute temperatures within the print head 500. Such temperature values may, for example, merely constitute intermediate values that are convenient for use in generating the absolute temperature predictions $T_a$ for the reference points 534 in resolution 532*c*. Similarly, the energy values E associated with reference points 536 and 538 may, but need not, correspond to predictions of heat accumulation within the print head 500. Such energy values may, for example, merely constitute intermediate values that are convenient for use in generating temperature values for the reference points 534 in resolution 532*c*.

In one embodiment, a relative temperature value T may also be associated with each of the reference points in the spatial grid 530. The relative temperature value T of a reference point in a particular resolution i is a temperature value that is relative to the absolute temperature of the corresponding reference point in the resolution i+1 above. As described in more detail below, the "corresponding" reference point may refer to an interpolated reference point in the resolution i+1.

The n and j coordinates of a reference point in a particular resolution is expressed using the notation (n,j). As used herein, the superscript $^{(i)}$ denotes a resolution number (i.e., a value of i). Therefore, the expression $E^{(i)}(n,j)$ refers to the energy value associated with the reference point having coordinates (n,j) in resolution i. Similarly, $T_a^{(i)}(n,j)$ refers to the absolute temperature value associated with the reference point having coordinates (n,j) in resolution i, and $T^{(i)}(n,j)$ refers to the relative temperature value associated with the reference point having coordinates (n,j) in resolution i. Because of the special meaning attributed to reference points in resolution 532*c* (where i=0), in one embodiment the expression $E^{(0)}(n,j)$ refers to the amount of input energy provided to print head element j during time interval n. Similarly, $T_a^{(0)}(n,j)$ refers to the predicted absolute temperature of print head element j at the beginning of time interval n, and $T^{(0)}(n,j)$ refers to the predicted relative temperature of print head element j at the beginning of time interval n.

In the description below, the suffix (*,*) refers to all the reference points in the time and space dimensions. For example, $E^{(k)}(*,*)$ denotes the energy for all the reference points in resolution k. The notation $I_{(k)}^{(m)}$ denotes an interpolation or decimation operator from resolution k to resolution m. When k>m, $I_{(k)}^{(m)}$ acts as an interpolation operator; when k<m, $I_{(k)}^{(m)}$ operates as a decimation operator. When applied to a two-dimensional array of values for a particular resolution of the grid 530 (e.g., $E^{(k)}(*,*)$), the operator $I_{(k)}^{(m)}$ is a two-dimensional interpolation or decimation operator that operates on both the space (i.e., along the j axis) and time (i.e., along the n axis) dimensions to produce a new array of values, based on the values of k and m, as just described. The number of values in the array produced by application of the operator $I_{(k)}^{(m)}$ is equal to the number of reference points in resolution m of the grid 530. Application of the operator $I_{(k)}^{(m)}$ is denoted in prefix form. For example, $I_{(k)}^{(m)}E^{(k)}(*,*)$ denotes application of the operator $I_{(k)}^{(m)}$ to the energies $E^{(k)}(*,*)$. The use of the operator $I_{(k)}^{(m)}$ will become clearer through the particular examples described below.

The operator $I_{(k)}^{(m)}$ may use any interpolation or decimation method. For example, in one embodiment of the present invention, the decimation function used by the operator $I^{(k)(m)}$ is an arithmetic mean and the interpolation method is linear interpolation.

It was stated above that the relative temperature value $T^{(i)}(n,j)$ is relative to the "corresponding" absolute temperature value $$T_a^{(i+1)}$$

in the layer i+1. It should now be clear that this "corresponding" absolute temperature value refers more precisely to $$(I_{(i+1)}^{(i)} T_a^{(i+1)})(n, j),$$

the absolute temperature value of the reference point at coordinates (n,j) in an array produced by applying the interpolation operator $$I_{(i+1)}^{(i)} \text{ to } T_a^{(i+1)}(*,*).$$

In one embodiment, the head temperature model 202 generates relative temperature values $T^{(i)}(n,j)$ as a weighted combination of the previous relative temperature value and the energy accumulated in the previous time interval, using Equation 4:

$$T^{(i)}(n,j)=T^{(i)}(n-1,j)\alpha_i+A_iE^{(i)}(n-1,j) \quad \text{Equation 4}$$

The variables $\alpha_i$ and $A_i$ in Equation 4 are parameters that may be estimated in any of a variety of ways, as described in more detail below. The parameter $\alpha_i$ represents the natural cooling of the print head, and the parameter $A_i$ represents heating of the print head due to accumulated energy. The head temperature model 202 also generates absolute temperature values $T_a^{(i)}(n,j)$ using Equation 5 and recursive Equation 6:

$$T_a^{(nresolutions)}(n,*) = T_S(n) \quad \text{Equation 5}$$

$$T_a^{(i)}(*,*) = I_{(i+1)}^{(i)} T_a^{(i+1)}(*,*) + T^{(i)}(*,*), \quad \text{Equation 6}$$

$$\text{for } i = nresolutions-1, nresolutions-2, \ldots, 0$$

More specifically, $$T_a^{nresolutions}(n,*)$$

is initialized by Equation 5 to $T_S(n)$, the absolute temperature measured by the temperature sensor 512. Equation 6 recursively calculates the absolute temperature values $T_a$ for each resolution as the sum of the relative temperatures of the resolutions above.

In one embodiment, the cooling effect of the media may be accounted for by modifying the relative temperature update at the finest resolution as shown in Equation 7:

$$T^{(0)}(n,j)=T^{(0)}(n-1,j)\alpha_0+A_0E^{(0)}(n-1,j)-\alpha_{media}(T_a^{(0)}(n-1,j)-T_{media}) \quad \text{Equation 7}$$

The parameter $\alpha_{media}$ controls the heat loss to the media, which depends on the conductivity of the media and the speed at which the media is moving past the print head. The variable $T_{media}$ denotes the absolute temperature of the media before it contacts the printhead. As shown in Equation 7, the heat loss is proportional to the absolute temperature difference between the print head and the media. Note that since the media cooling only affects the finest resolution, Equation 7 is used only for the finest resolution (i.e. i=0) and Equation 4 is used to update the relative temperature of all other layers (i.e. i>0).

In one embodiment, the relative temperatures $T^{(i)}(n,j)$ produced in Equation 6 and Equation 7 are further modified by Equation 8:

$$T^{(i)}(n,j)=(1-2k_i)T^{(i)}(n,j)+k_i(T^{(i)}(n,j-1)+T^{(i)}(n,j+1)) \text{ for } j=0 \text{ to } j_{max} \quad \text{Equation 8}$$

Equation 8 represents the lateral heat transfer between print head elements. The inclusion of lateral heat transfer in the head temperature model results in a compensating lateral sharpening of the image in the inverse printer model. It should be appreciated that although Equation 8 uses a three-point kernel (consisting of reference point j and its two immediate neighbors at locations j+1 and j−1), this is not a limitation of the present invention. Rather, any size kernel may be used in Equation 8. A boundary condition must be provided for $T^{(i)}(n,j)$ where j=0 and $j=j_{max}$, so that values of $T^{(i)}(n,j)$ for j=−1 and $j=j_{max}+1$ may be provided for use in Equation 8. For example, $T^{(i)}(n,j)$ may be set to zero for j=−1 and $j=j_{max}+1$. Alternatively, $T^{(i)}(n,-1)$ may be assigned the value of $T^{(i)}(n,0)$ and $T^{(i)}(n,j_{max}+1)$ may be assigned the value of $T^{(i)}(n,j_{max})$. These boundary conditions are provided merely for purposes of example and do not constitute limitations of the present invention; rather, any boundary conditions may be used.

In one embodiment, the energies $E^{(0)}(n,j)$ (i.e., the energies to be provided to the print head elements 520*a–i* during time interval n) are computed using Equation 9, which is derived from Equation 3:

$$E^{(0)}(n,j)=G(d(n,j))+S(d(n,j))T_a^{(0)}(n,j) \quad \text{Equation 9}$$

The values $E^{(0)}(n,j)$ defined by Equation 9 allows values of $E^{(i)}(n,j)$ for i>0 to be recursively calculated using Equation 10:

$$E^{(i)}(n, j) = I_{(i-1)}^{(i)} T^{(i-1)}(n, j), \quad \text{Equation 10}$$

$$\text{for } i = 1, 2, \ldots, nresolution-1$$

The order in which Equation 4–Equation 10 may be computed is constrained by dependencies among these equations. Examples of techniques for computing Equation 4–Equation 10 in an appropriate order are described in more detail below.

The head temperature model 202 and the media density model 304 include several parameters which may be calibrated as follows. Referring again to FIG. 1, the thermal printer 108 may be used to print a target image (serving as the source image 100), producing printed image 110. During the printing of the target image, measurements may be taken of: (1) the energies used by the thermal printer 108 to print the target image, (2) the ambient temperature of the print head over time; and (3) the media temperature. The measured energies and temperatures are then provided as inputs to the thermal printer model 302. The density distribution of the predicted printed image 306 predicted by the thermal printer model 302 is compared to the actual density distribution of the printed image 110 produced by printing the target image. The parameters of the head temperature model 202 and the media density model 304 are then modified based on the results of this comparison. The process is repeated until the density distribution of the predicted printed image 306 sufficiently matches that of the printed image 110 corresponding to the target image. The parameters of the head temperature model 202 and media density model 304 thereby obtained are then used in the head temperature model 202 and inverse media density model 206 of the inverse printer model 102 (FIG. 2). Examples of parameters that may be used in these models are described in more detail below.

In one embodiment of the present invention, the gamma function Γ(E) that we discussed in regard to the inverse media model is parameterized as an asymmetric S-shaped function as shown in Equation 11:

$$\Gamma(E) = \frac{d_{\max}}{1 + e^{-4\sigma(a\varepsilon^3 + b\varepsilon^2 + \varepsilon)}} \qquad \text{Equation 11}$$

, where $\epsilon = E - E_0$, and $E_0$ is an energy offset. When a=0 and b=0, Γ(E) shown in Equation 11 is a symmetrical function about the energy $E_0$, and has a slope $d_{max}\sigma$ at $E=E_0$. However, typical gamma curves for thermal printers are often asymmetrical and are better represented with values of a and b that are not zero. The function $T_\Gamma(d)$ described above with respect to FIG. 4 may be estimated in any of a variety of ways. The function $T_\Gamma(d)$ may, for example, be an estimate of the print head element temperature when the gamma function Γ(E) was measured. Such an estimate may be obtained from the head temperature model.

In one embodiment, the sensitivity function S(d) is modeled as an p-order polynomial, as shown in Equation 12:

$$S(d) = \sum_{m=0}^{p} a_m d^m \qquad \text{Equation 12}$$

In a preferred embodiment, a third order polynomial, p=3, is used, although this is not a limitation of the present invention. Rather, the sensitivity function S(d) may be a polynomial of any order.

It should be appreciated that the gamma and sensitivity functions shown in Equation 11 and Equation 12 are shown merely for purposes of example and do not constitute limitations of the present invention. Rather, other mathematical forms for the gamma and sensitivity functions may be used.

Figure 6A:
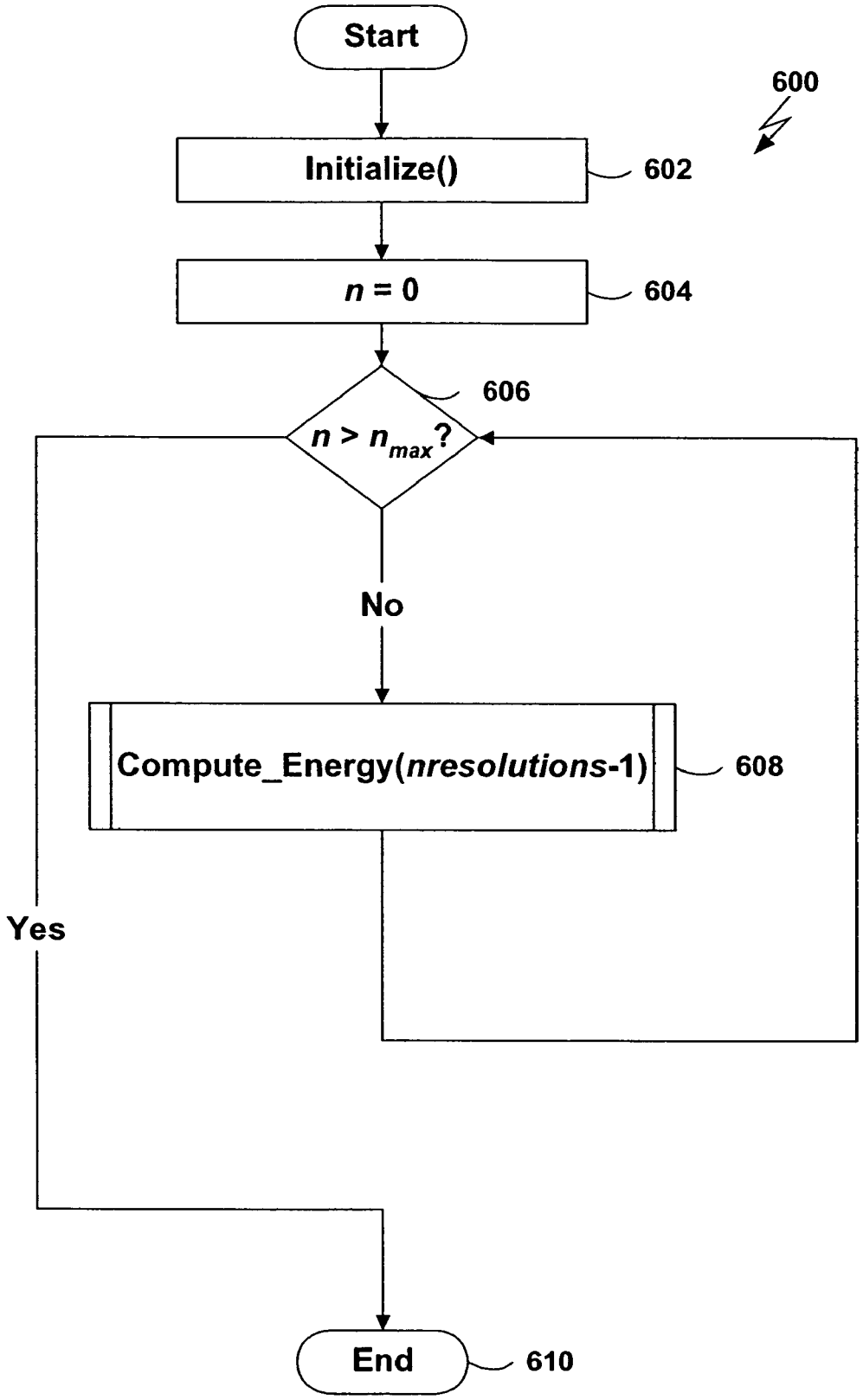
FIGS. 6A–6D are flow charts of processes that are used to compute energies to be provided to thermal print head elements according to one embodiment of the present invention.

Having described generally how the head temperature model 202 models the thermal history of the print head 500, one embodiment for applying the techniques described above is now described in more detail. In particular, referring to FIG. 6A, a flow chart of a process 600 that is used to print the source image 100 (FIG. 1) according to one embodiment of the present invention is shown. More specifically, the process 600 may be executed by the inverse printer model 102 to generate and provide the input energy 106 to the thermal printer 108 based on the source image 100 and the ambient temperature of the print head 104. The thermal printer 108 may then print the printed image 110 based on the input energy 106.

As described above, the head temperature model 202 may calculate values for the relative temperatures T, absolute temperatures $T_a$, and energies E. As further described above, the interrelations of the equations used to perform these calculations impose constraints on the order in which the calculations may be performed. The process 600 performs these calculations in an appropriate order, thereby calculating the input energies $E^{(0)}(n,*)$ to provide to the print head elements 520*a–i* during each time interval n. As used herein, the suffix (n,*) refers to (absolute temperature $T_a$, relative temperature T, or energy E) values for all reference points in a particular resolution at discrete time interval n. For example, $E^{(i)}(n,*)$ refers to the energy values of all reference points (i.e., for all values of j) in resolution i during discrete time interval n. The process 600 may, for example, be implemented in software using any suitable programming language.

In one embodiment, for each time interval n, the process 600 makes reference only to energies and temperatures from time interval n and from the previous time interval n−1. It is therefore unnecessary to keep a permanent storage of these quantities for all n. The two dimensional arrays, $T^{(i)}(*,*)$, $T_a^{(i)}(*,*)$, and $E^{(i)}(*,*)$ can each be replaced by just two one-dimensional arrays, with subscripts "new" and "old" replacing the time dimension arguments n and n−1 respectively. Specifically, the following one-dimensional arrays are used to store intermediate values at the time interval n:

(1) $T_{old}^{(i)}(*)$, an array for storing relative temperatures of all the reference points in resolution i from the previous print time interval (i.e., print time interval n−1).

$$T_{old}^{(i)}(*)$$

is equivalent to $T^{(i)}(n-1,*)$;

(2) $T_{new}^{(i)}(*)$, an array for storing relative temperatures of all the reference points in resolution i in the current time interval n.

$$T_{new}^{(i)}(*)$$

is equivalent to $T^{(i)}(n,*)$;

(3) $ST_{old}^{(i)}(*)$, an array for storing absolute temperatures of all the reference points in resolution i from the previous time interval n−1.

$$ST_{old}^{(i)}(*)$$

is equivalent to $T_a^{(i)}(n-1,*)$;

(4) $ST_{new}^{(i)}(*)$, an array for storing absolute temperatures of all the reference points in resolution i in the current time interval n−1.

$ST_{new}^{(i)}(*)$ is equivalent to $T_a^{(i)}(n,*)$; and (5) $E_{acc}^{(i)}(*)$ an array for storing the current accumulated energies of all the reference points in resolution i in the current time interval n.

$E_{acc}^{(i)}(*)$ is equivalent to $E^{(i)}(n,*)$.

Note that the interpolation operator $I_k^n$, when applied to any of the five one-dimensional arrays above, results in a one-dimensional interpolation or decimation of the spatial domain. Time interpolation is carried out separately by reference to the explicitly stored 'old' and 'new' values of T or ST.

The process 600 begins by calling a routine Initialize( ) (step 602). The Initialize( ) routine may, for example: (1) initialize $T_{new}^{(i)}(*)$ and $E_{acc}^{(i)}(*)$ to zero (or some other predetermined value) for all values of i (i.e., from i=0 to i=nresolutions−1), and (2) initialize $ST_{new}^{(i)}(*)$ to $T_S$ (the temperature reading from the temperature sensor 512) for all values of i from i=0 to i=nresolutions.

The process 600 initializes the value of n to zero (step 604), corresponding to the first print head cycle of the source image 100 to be printed. The process 600 compares the value of n to $n_{max}$ (the total number of print head cycles required to print the source image 100) to determine whether the entire source image 100 has been printed (step 606). If n is greater than $n_{max}$, the process 600 terminates (step 610). If n is not greater than $n_{max}$, then a subroutine Compute_Energy( ) is called with a value of nresolutions−1 (step 608).

Figure 6B:
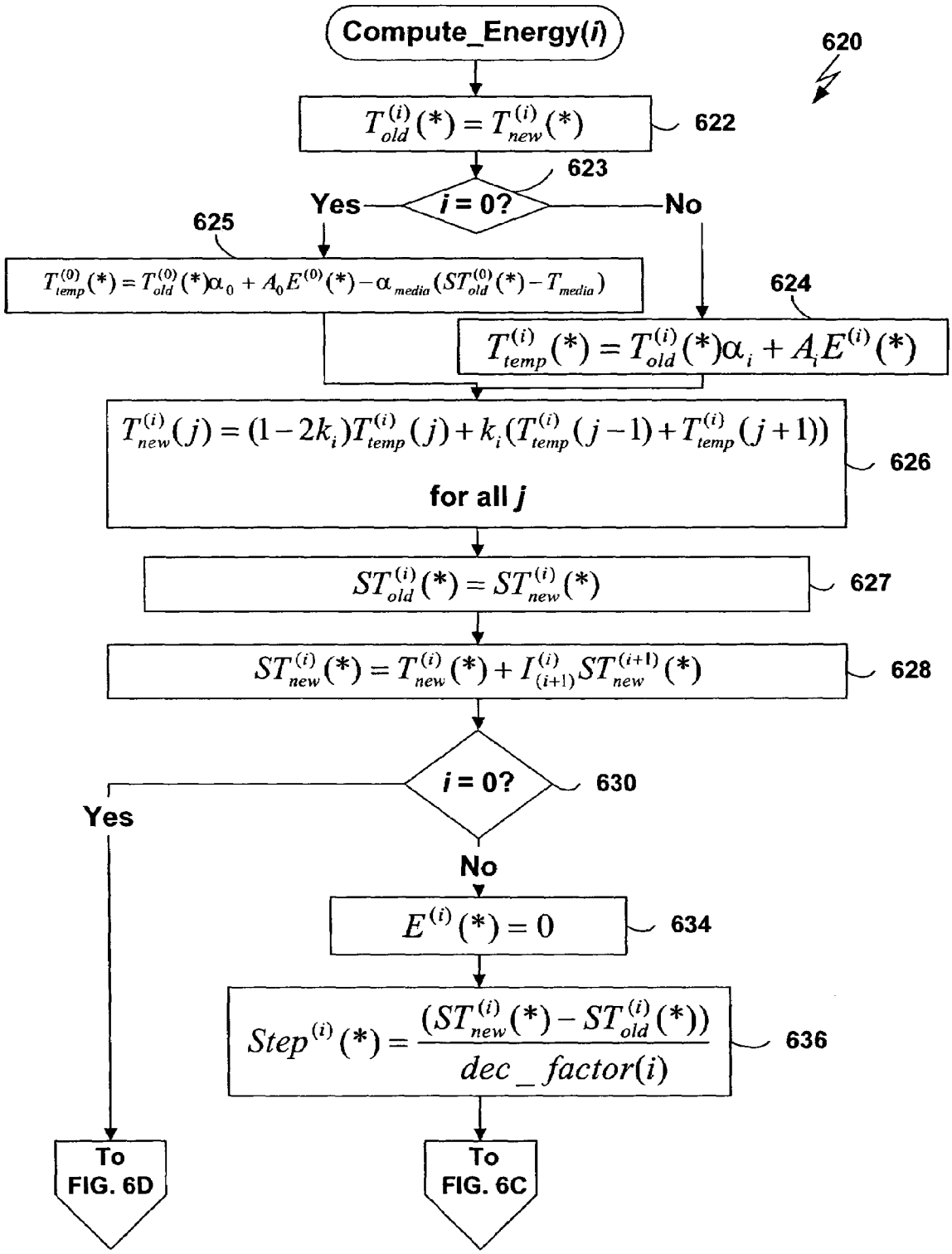

Compute_Energy(i) takes as an input a resolution number i, and computes the input energies $E_{acc}^{(i)}(*)$, in accordance with the equations described above. Referring to FIG. 6B, in one embodiment, Compute_Energy( ) is implemented using a recursive process 620. As described in more detail below, in the course of computing $E_{acc}^{(i)}(*)$, the process 620 also recursively computes each of the energies $E_{acc}^{(i-1)}(*)$, $E_{acc}^{(i-2)}(*)$ . . . $E_{acc}^{(0)}(*)$ in a particular pattern. When the energies $E_{acc}^{(0)}(*)$ are computed, they are provided to the print head elements 520*a–i* to produce the desired output densities and the value of n is incremented.

More specifically, the process 620 initializes the array $T_{old}^{(i)}$ by assigning to it the values of $T_{new}^{(i)}$ (step 622). The process 620 determines whether i=0 (step 623). If i≠0, the process updates the relative temperatures in time by assigning values to a temporary array $T_{temp}^{(i)}$ using Equation 4 (step 624). Otherwise, the process updates the relative temperatures in time by assigning values to the temporary array $T_{temp}^{(i)}$ using Equation 7 (step 625). The process 620 updates the relative temperatures in space by assigning values to $T_{new}^{(i)}$ using Equation 8 (step 626).

The process 620 then computes the current and previous absolute temperature $ST_{new}^{(i)}(*)$ and $ST_{old}^{(i)}(*)$.

More specifically, the value of $ST_{old}^{(i)}(*)$ is set to $ST_{new}^{(i)}(*)$ (step 627). Then the process 620 updates the current absolute temperatures in resolution i based on the relative temperatures in resolution i and the absolute temperatures in resolution i+1, using Equation 6 (step 628). The interpolation operator $$I_{(i+1)}^{(i)}$$

is applied to $$ST_{new}^{(i+1)}(*),$$

producing an array of interpolated absolute temperature values. The dimension of this array is equal to the spatial dimension of resolution i. This array of interpolated absolute temperature values is added to $$T_{new}^{(i)}(*)$$

to produce $$ST_{new}^{(i)}(*).$$

In this manner, absolute temperature values are propagated downward from layer i+1 to layer i. It should be appreciated that absolute temperatures are propagated downward between successive layers in a particular pattern over time resulting from the recursion performed by Compute_Energy( ).

The process 620 tests whether i=0 to determine whether energies are currently being computed for the bottom (finest) resolution (step 630). This test is necessary to determine whether the absolute temperatures need to be interpolated in time in order to provide reference absolute temperatures for the layer below. In the event that i=0, absolute temperatures are being computed for the finest resolution, and no time interpolation is required.

In the event that i is not zero, temporal interpolation is required. The quantity dec_factor(i) represents the ratio of the number of reference points in the temporal dimension in resolution i−1 to the number in resolution i. Therefore, it is necessary to generate dec_factor(i) interpolated absolute temperatures. It should be appreciated that dec_factor(i) may have any value for each value of i; for example, dec_factor(i) may be equal to one for each value of i, in which case various steps described below may be simplified or eliminated as will be apparent to those of ordinary skill in the art. At the same time, the energies $E_{acc}^{(i)}(*)$ are computed by accumulating the energies $E_{acc}^{(i-1)}(*)$ for all dec_factor(i) interpolated points in the time dimension. These two tasks are accomplished by the following steps.

The energies $E_{acc}^{(i)}(*)$ are initialized to zero (step 634). An array $Step^{(i)}(*)$ is used to store step values to interpolate between $$ST_{old}^{(i)} \text{ and } ST_{new}^{(i)}.$$

The values in $Step^{(i)}(*)$ are initialized by dividing the difference between $$ST_{new}^{(i)} \text{ and } ST_{old}^{(i)}$$

by dec_factor(i) (step 636).

Figure 6C:
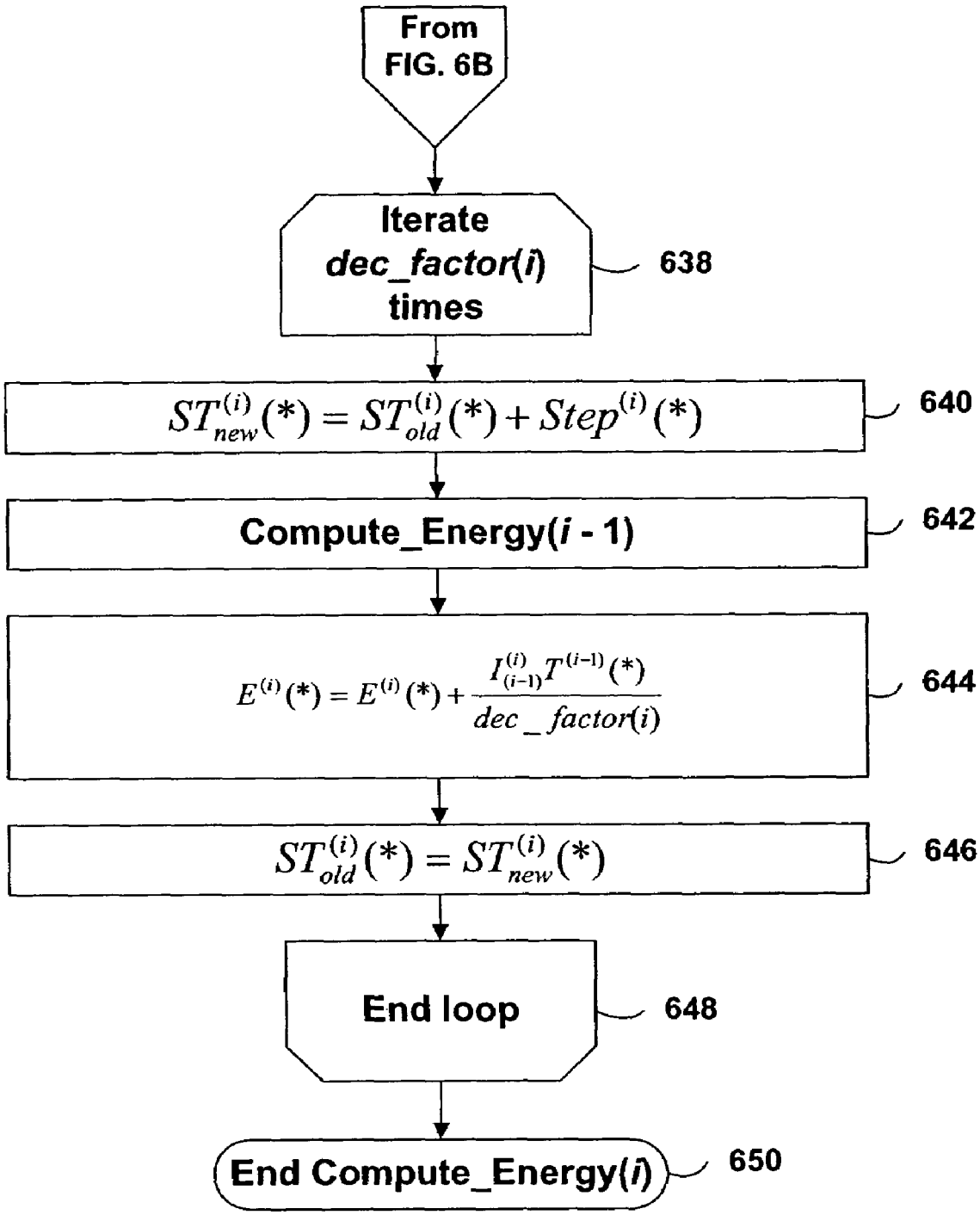
Figure 6D:
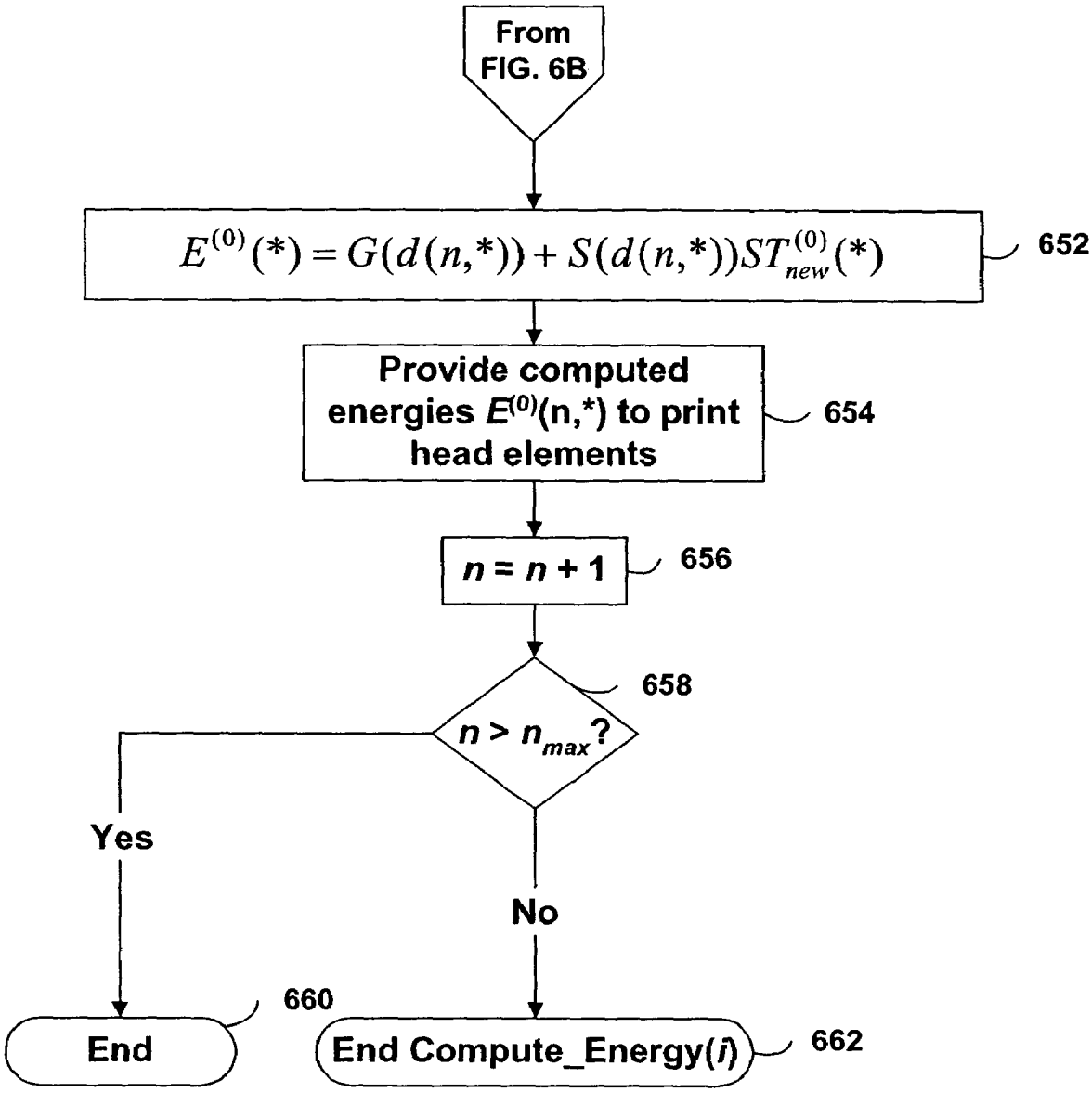

Referring to FIG. 6C, the process 620 enters a loop having dec_factor(i) iterations (step 638).

$$ST_{new}^{(i)}$$

is assigned interpolated values by adding Step (i) to $$ST_{old}^{(i)}$$

(step 640). Compute_Energy( ) is recursively called to compute energies for resolution i−1 (step 642). After obtaining the energies computed for resolution i−1, energies $E_{acc}^{(i)}(*)$ for the current resolution i are partially computed using Equation 10 (step 644).

Note that in Equation 10, the notation describes a two-dimensional decimation of the energies in resolution i−1 in space and time. Since $E_{acc}^{(i-1)}(*)$ is a one-dimensional array representing energies of the reference points in resolution i−1 in the spatial dimension, Step 644 achieves the same result step-wise through an explicit averaging of $E_{acc}^{(i)}(*)$ in the time dimension. It should be appreciated that the energies $E_{acc}^{(i)}(*)$ are not computed in their entirety until the loop initiated in step 638 has completed all of its iterations.

$$ST_{old}^{(i)}$$

is assigned the values of $$ST_{new}^{(i)}$$

in preparation for the next iteration of the loop initiated in step 638 (step 646). The loop performs steps 640–646 a total of dec_factor(i) times. At the completion of the loop (step 648), all energies $E_{acc}^{(i)}(*)$ for resolution i have been computed, and all necessary absolute temperatures have been propagated downward to finer resolutions. Therefore, Compute_Energy(i) terminates (step 650) and returns control to Compute_Energy(i+1) (step 644) which initiated it. When control has finally been returned to level i=nresolutions−1, Compute_Energy(i) terminates (step 650) and returns control to process 600 at step 606.

Returning again to step 630 (FIG. 6B), if i=0 then Compute_Energy( ) is being asked to compute energies $E_{acc}^{(0)}(*)$ for the bottom (finest) resolution. In one embodiment, the energies $E_{acc}^{(0)}(*)$ are the energies to be provided to the print head elements 520*a–i*. The process 620 computes the energies $E_{acc}^{(0)}(*)$ using Equation 3 (step 652). The process 620 provides the energies $E_{acc}^{(0)}(*)$ to the print head elements 520*a–i* to produce the desired densities d(n,*) (step 654).

As described above, the number of reference points in resolution i=0 may be different (greater or less) than the number of print head elements 520*a–i*. If there fewer reference points than elements, the absolute temperatures $$ST_{new}^{(0)}(*)$$

are interpolated to the resolution of the print head elements, and then step 652 is applied to compute the energies $E_{acc}^{(0)}(*)$ to be provided to the print head elements in step 654. The energies $E_{acc}^{(0)}(*)$ are then decimated back to resolution i=0, and process 620 is resumed.

The value of n is incremented, representing an advance in time to the next print head cycle (step 656). If $n>n_{max}$ (step 658), printing of the source image 100 is complete and both processes 620 and 600 terminate (step 660). Otherwise, Compute_Energy(i) terminates (step 662), representing the bottoming-out of the recursion used by Compute_Energy(i). Termination of Compute_Energy(i) at step 662 returns control to Compute_Energy(i+1) at step 644 (FIG. 6C). The process 600 repeats step 608 until printing of the digital image is complete.

It should therefore be appreciated that the processes 600 and 620 shown in FIGS. 6A–6D may be used to print a digital image (e.g., the source image 100) in accordance with the techniques for thermal history compensation described above.

It should be appreciated that features of various embodiments of the present invention described above and described in more detail below provide numerous advantages.

One advantage of various embodiments of the present invention is that they reduce or eliminate the problem of "density drift" described above. More precisely, by taking the current ambient temperature of the print head and the thermal and energy histories of the print head into account when computing the energy to be provided to the print head elements, the print head elements are more accurately raised only to the temperatures necessary to produce the desired densities.

A further advantage of various embodiments of the present invention is that they may either increase or decrease the input energy $E^{(O)}(*,*)$ provided to the print head elements 520*a–i*, as may be necessary or desirable to produce the desired densities d(*,*). Conventional systems that attempt to compensate for the effects of thermal history typically decrease the amount of energy provided to the thermal print heads to compensate for increase in temperature of the print head elements over time. In contrast, the generality of the models used by various embodiments of the present invention enable them to flexibly increase or decrease the amount of energy provided to particular print head elements.

Figure 7:
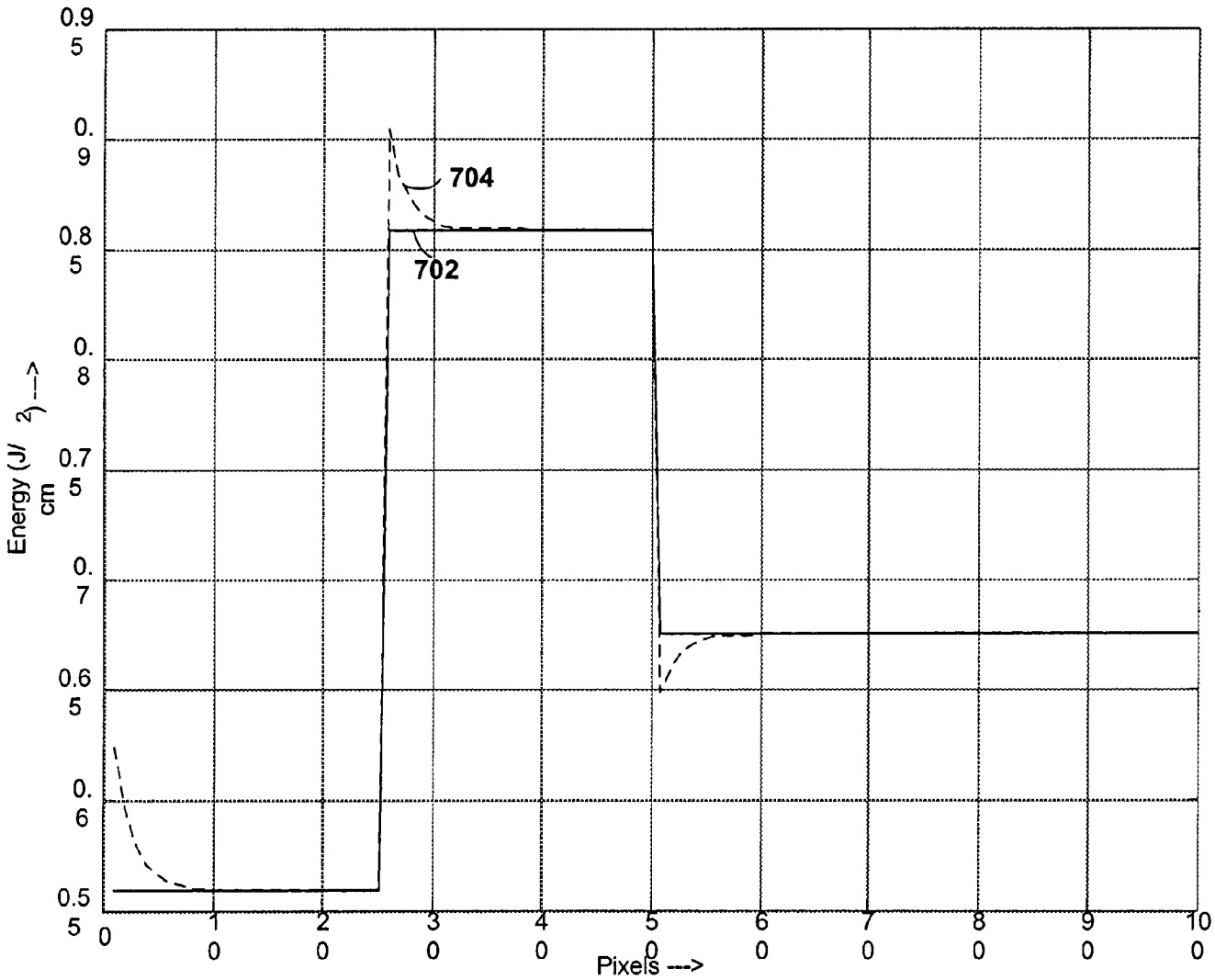
FIG. 7 is a graph illustrating energy provided to a thermal print head element by a conventional thermal printer and by one embodiment of the present invention.

For example, referring to FIG. 7 two graphs 702 and 704 are shown of energy provided to a print head element over time. Both graphs 702 and 704 represent the amount of energy provided to the print head element to print a column of pixels including two high density gradients (located approximately at pixels numbered 25 and 50, respectively). Graph 702 (illustrated in solid line) represents energy provided to the print head element by a conventional thermal printer, and graph 704 (illustrated in dashed line) represents energy provided to the print head element by one embodiment of the inverse printer model 102. As shown in graph 704, the inverse printer model 102 provides a greater amount of energy than the conventional thermal printer at the first high density gradient. This will tend to raise the temperature of the print head element more quickly and thereby produce a sharper edge in the output. Similarly, the inverse printer model 102 provides a lesser amount of energy than the conventional thermal printer at the second high density gradient. This will tend to lower the temperature of the print head element more quickly and thereby produce a sharper edge in the output.

It should be appreciated based on the discussion of FIG. 7 above that various embodiments of the present invention may flexibly increase or decrease the amount of energy provided to the print head elements as necessary to produce the desired output densities d. The flexibility of the inverse printer model 206 enables the correction factors ΔE(n) (FIG. 4) (which are used to produce the input energies E(n)) to vary in any appropriate manner and in any combination from print head element to print head element, and from print head cycle to print head cycle. For example, the correction factors ΔE(n) may be positive, negative, or zero in any combination. Furthermore, the correction factor ΔE(n, j) for a particular print head element j may increase, decrease, or remain the same from one print head cycle to the next. The correction factors for a plurality of print head elements may increase, decrease, or remain the same from print head cycle to print head cycle, in any combination. For example, the correction factor for a first print head element $j_1$ may increase from one print head cycle to the next, while the correction factor for a second print head element $j_2$ decreases.

These examples of the variety of correction factors that may be produced by the inverse media density model 206 are merely examples that illustrate the flexibility of the inverse media density model 206 illustrated in FIG. 4. More generally, the ability of the inverse media density model 206 to accurately compensate for the effects of the thermal history of the thermal printer 108 enables it to mitigate the effects of various problems typically associated with thermal printers, such as density drift and blurred edges. Various other advantages of the inverse media density model 206 and other aspects and embodiments of the present invention will be apparent to those of ordinary skill in the art.

Another advantage of various embodiments of the present invention is that they compute the energies to be provided to the print head elements in a computationally efficient manner. For example, as described above, in one embodiment of the present invention, the input energy is computed using two one-dimensional functions (G(d) and S(d)), thereby enabling the input energy to be computed more efficiently than with the single two-dimensional function $F(d,T_s)$.

In particular, if f is the decimation factor between any two resolutions, an upper bound on the number of additions performed per pixel in one embodiment is given by Equation 13:

$$\frac{5f^2+1}{f^2-1}+2\approx 7 \text{ for large } f \qquad \text{Equation 13}$$

Furthermore, in one embodiment an upper bound on the number of multiplications performed per pixel in one embodiment is given by Equation 14:

$$\frac{4f^2+3}{f^2-1}+1\approx 5 \text{ for large } f \qquad \text{Equation 14}$$

In one embodiment, two lookups are performed per pixel. In experimental use various embodiments of the present invention have been shown to be capable of computing the input energy sufficiently rapidly to permit real-time use in a thermal printer having a print head cycle period of 1.6 ms.

The present invention has been described above in terms of various embodiments. Various other embodiments, including but not limited to the following, are also within the scope of the claims.

Although some embodiments may be described herein with respect to thermal transfer printers, it should be appreciated that this is not a limitation of the present invention.

Rather, the techniques described above may be applied to printers other than thermal transfer printers (e.g. direct thermal printers). Furthermore, various features of thermal printers described above are described merely for purposes of example and do not constitute limitations of the present invention.

Various aspects of the embodiments described above are provided merely for purposes of example and do not constitute limitations of the present invention. For example, there may be any numbers of layers in the print head 500 and any number of resolutions in the model of the thermal print head. Furthermore, there need not be a one-to-one correspondence between print head layers and resolutions. Rather, there may be a many-to-one or one-to-many relationship between print head layers and resolutions. There may be any number of reference points in each resolution, and there may be any decimation factor between resolutions. Although particular gamma and sensitivity functions are described above, other functions may be used.

It should be appreciated that the results of the various equations shown and described above may be generated in any of a variety of ways. For example, such equations (such as Equation 1) may be implemented in software and their results calculated on-the-fly. Alternatively, lookup tables may be pre-generated which store inputs to such equations and their corresponding outputs. Approximations to the equations may also be used to, for example, provide increased computational efficiency. Furthermore, any combination of these or other techniques may be used to implement the equations described above. Therefore, it should be appreciated that use of terms such as "computing" and "calculating" the results of equations in the description above does not merely refer to on-the-fly calculation but rather refers to any techniques which may be used to produce the same results.

In general, the techniques described above may be implemented, for example, in hardware, software, firmware, or any combination thereof. The techniques described above may be implemented in one or more computer programs executing on a programmable computer and/or printer including a processor, a storage medium readable by the processor (including, for example, volatile and non-volatile memory and/or storage elements), at least one input device, and at least one output device. Program code may be applied to data entered using the input device to perform the functions described herein and to generate output information. The output information may be applied to one or more output devices.

Printers suitable for use with various embodiments of the present invention typically include a print engine and a printer controller. The printer controller receives print data from a host computer and generates page information to be printed based on the print data. The printer controller transmits the page information to the print engine to be printed. The print engine performs the physical printing of the image specified by the page information on the output medium.

Elements and components described herein may be further divided into additional components or joined together to form fewer components for performing the same functions.

Each computer program within the scope of the claims below may be implemented in any programming language, such as assembly language, machine language, a high-level procedural programming language, or an object-oriented programming language. The programming language may be a compiled or interpreted programming language.

Each computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output.

It is to be understood that although the invention has been described above in terms of particular embodiments, the foregoing embodiments are provided as illustrative only, and do not limit or define the scope of the invention. Other embodiments are also within the scope of the present invention, which is defined by the scope of the claims below. Other embodiments that fall within the scope of the following claims includes include, but are not limited to, the following.

What is claimed is:

1. In a thermal printer including a print head element, a method comprising steps of:

(A) predicting a temperature of the print head element based on an ambient temperature, an energy previously provided to the print head element, and a temperature of a print medium on which the print head element is to print; and (B) computing an input energy to provide to the print head element based on the predicted temperature of the print head element and a plurality of one-dimensional functions of a desired output density to be printed by the print head element.

2. The method of claim 1, wherein the plurality of one-dimensional functions comprises:

an inverse gamma function having the desired output density as an input and an uncorrected input energy as an output; and a correction function having the current temperature of the print head element as an input and a correction factor as an output; and wherein the step (A) comprises a step of computing the input energy by adding the correction factor to the uncorrected input energy.

3. The method of claim 2, wherein the correction function develops the correction factor by performing steps of:

developing a temperature difference value by subtracting a reference temperature from the current temperature of the print head element; and developing the correction factor as the product of the temperature difference value and the output of a sensitivity function having the desired output density as an input and a sensitivity value as an output.

4. A thermal printer comprising:

a print head element;

means for predicting a temperature of the print head element based on an ambient temperature, an energy previously provided to the print head element, and a temperature of a print medium on which the print head element is to print; and means for computing an input energy to provide to the print head element based on the predicted temperature of the print head element and a plurality of one-dimensional functions of a desired output density to be printed by the print head element.

5. The thermal printer of claim 4, wherein the means for computing the input energy comprises:

inverse gamma function means having the desired output density as an input and an uncorrected input energy as an output;

correction function means having the current temperature of the print head element as an input and a correction factor as an output; and means for computing the input energy by adding the correction factor to the uncorrected input energy.

6. The thermal printer of claim 5, wherein the correction function means comprises:

means for developing a temperature difference value by subtracting a reference temperature from the current temperature of the print head element; and means for developing the correction factor as the product of the temperature difference value and the output of a sensitivity function having the desired output density as an input and a sensitivity value as an output.

7. In a thermal printer having a print head including a plurality of print head elements, a method for developing, for each of a plurality of print head cycles, a plurality of input energies to be provided to the plurality of print head elements during the print head cycle to produce a plurality of output densities, the method comprising steps of:

(A) using a multi-resolution heat propagation model to develop, for each of the plurality of print head cycles, a plurality of predicted temperatures of the plurality of print head elements at the beginning of the print head cycle based on an ambient temperature, a plurality of input energies provided to the plurality of print head elements during at least one previous print head cycle, and a temperature of a print medium on which the print head element is to print; and (B) using an inverse media model to develop the plurality of input energies based on the plurality of predicted temperatures and a plurality of densities to be output by the plurality of print head elements during the print head cycle.

8. The method of claim 7, further comprising a step of:

(C) defining a three-dimensional grid having an i axis, an n axis, and a j axis, wherein the three-dimensional grid comprises a plurality of resolutions, wherein each of the plurality of resolutions defines a plane having a distinct coordinate on the i axis, wherein each of the plurality of resolutions comprises a distinct two-dimensional grid of reference points, and wherein any one of the reference points in the three-dimensional grid may be uniquely referenced by its i, n, and j coordinates;

wherein associated with each of the reference points in the three-dimensional grid is an absolute temperature value and an energy value;

wherein the absolute temperature value associated with a reference point having coordinates (0,n,j) corresponds to a predicted temperature of a print head element at location j at the beginning of time interval n, and wherein the energy value associated with the reference point having coordinates (0,n,j) corresponds to an amount of input energy to provide to the print head element at location j during time interval n; and wherein the step (B) comprises a step of:

(B)(1) developing the plurality of input energies by developing energy values associated with a plurality of reference points having an i coordinate of zero based on the plurality of output densities and the absolute temperature values associated with the plurality of reference points having an i coordinate of zero.

9. The method of claim 8, further comprising steps of:

(D) calculating relative temperature values using the following equations:

$$T^{(i)}(n,j)=T^{(i)}(n-1,j)\alpha_i+A_iE^{(i)}(n-1,j);$$

and $$T_{(i)}(n,j)=(1-2k_i)T^{(i)}(n,j)+k_i(T^{(i)}(n,j-1)+T^{(i)}(n,j+1))$$

in which $T^{(i)}(n,j)$ refers to a relative temperature value associated with a reference point having coordinates (i,n,j);

(E) calculating absolute temperature values using the following recursive equation:

$$T_a^{(i)}(*,*) = I_{(i+1)}^{(i)}T_a^{(i+1)}(*,*) + T^{(i)}(*,*),$$

for i=nresolutions−1, nresolutions−2, . . . , 0;

with initial conditions specified by:

$$T_a^{(nresolutions)}(n,*) = T_s(n),$$

wherein nresolutions is the number of resolutions in the three-dimensional grid, $T_S$ is an ambient temperature, $T_a^{(i)}(n,j)$ refers to an absolute temperature value associated with a reference point having coordinates (i,n,j), and $$I_{(i+1)}^{(i)}$$

is an interpolation operator from resolution i+1 to resolution i; and wherein the step (B)(1) comprises a step of:

calculating the plurality of input energies using the following recursive equation:

$$E^{(i)}(n,j)=I_{i-1)}{}^{(i)}T^{(i-1)}(n,j), \text{ for } i=1, 2, \ldots, \text{nresolutions}-1;$$

with initial conditions specified by $$E^{(0)}(n,j)=G(d(n,j))+S(d(n,j))T_a^{(0)}(n,j)$$

wherein G(d(n,j)) relates the desired output density d to an uncorrected input energy $E_T$, $T_a^{(0)}(n,j)$ is an absolute temperature value associated with a reference point having coordinates (0,n,j), and S(d(n,j)) is a the slope of the temperature dependence of G(d(n,j)).

10. The method of claim 9, wherein the step (D) comprises a step of calculating relative temperature values for i=0 using the following equation:

$$T_{(0)}(n,j)=T^{(0)}(n-1,j)\alpha_0+A_0E^{(0)}(n-1,j)-\alpha_{media}(T_a^{(0)}(n-1,j)-T_{media}),$$

wherein $\alpha_{media}$ controls heat loss to a print medium on which the print head is to print, and wherein $T_{media}$ represents an absolute temperature of the medium before it contacts the print head.

* * * * *